US005728499A

United States Patent [19]

Hung et al.

[11] Patent Number: 5,728,499

[45] Date of Patent: Mar. 17, 1998

[54] PROTECTIVE LAYER COMPOSITION OF ELECTROPHOTOGRAPHIC PHOTORECEPTOR

[75] Inventors: Tzea-Ching Hung, Chiang-Hwa Hsien; Chen-Jen Yang, Taipel Hsien; Kuo-Chu Yeh, Miao-Li Hsien, all of Taiwan

[73] Assignee: Sinonar Corp., Hsinchu, Taiwan

[21] Appl. No.: 874,551

[22] Filed: Jun. 13, 1997

[51] Int. Cl.[6] ..... G03G 5/147

[52] U.S. Cl. ..... 430/67; 430/66; 430/58

[58] Field of Search ..... 430/66, 67

[56] References Cited

U.S. PATENT DOCUMENTS

| | | | |
|---|---|---|---|
| 4,390,609 | 6/1983 | Wiedemann | 430/67 |
| 4,489,148 | 12/1984 | Horgan | 430/67 |
| 4,888,262 | 12/1989 | Tamaki et al. | 430/67 |
| 5,215,844 | 6/1993 | Badesha et al. | 430/66 |
| 5,292,603 | 3/1994 | Sakai et al. | 430/66 |

*Primary Examiner*—Roland Martin
*Attorney, Agent, or Firm*—W. Wayne Liauh

[57] ABSTRACT

An electrophotographic photoreceptors having a protective layer which contains a specially cross-linked phenolic resin. The cross-linked phenolic resin contains both methylene ether linkages and methylene linkages that are provided such that the oxygen element content of the cross-linked phenolic resin contains no greater than 23.5 wt %, or more preferably between about 21 wt % and 23.5 wt %, of oxygen atoms. In a preferred embodiment, the specially cross-linked phenolic resin is formed by (a) raising the cross-linking temperature from 80°±10° C. to about 130° C., in a cascading manner involving at least one intermediate treatment temperature; then (b) lowering the cross-linking temperature from about 130° C. to 80°±10° C. The protective layer improves the chemical stability and mechanical strength of the electrophotographic photoreceptor while retaining the desired photoelectric properties thereof.

16 Claims, No Drawings

PROTECTIVE LAYER COMPOSITION OF ELECTROPHOTOGRAPHIC PHOTORECEPTOR

FIELD OF THE INVENTION

The present invention relates to electrophotographic photoreceptors with a protective layer. More specifically, the present invention relates to electrophotographic photoreceptors which contain a protective layer for improved mechanical strength thus maintaining high print quality after repeated use. The present invention also relates to a novel cross-linked phenolic resin composition for such use as a protective layer in electrophotographic photoreceptors. The novel cross-linked phenolic resin composition of the present invention imparts improved chemical stability and mechanical strength to electrophotographic photoreceptors, while, at the same time, allowing these electrophotographic photoreceptors to retain desired photoelectric properties.

BACKGROUND OF THE INVENTION

Photoreceptors, sometimes referred to as electrophotographic imaging members, are one of the most important elements in electrophotographic imaging devices such as laser printers. Photoreceptors can be classified into organic photoreceptors and inorganic photoreceptors. Because of their relatively ease of fabricability and low or none toxicity, organic photoreceptors have become the dominate type.

Organic photoreceptors, however, also suffer from the disadvantages of having relatively inferior mechanical strength and chemical resistance. Most organic photoreceptors are provided in a multi-layer structure. The most common type of the multi-layered photoreceptor consists of a charge transport layer and a charge generation layer provided in this order on top of a conductive aluminum substrate. Optionally a resin binder layer can be provided between the charge generation layer and the substrate to provide insulation and improve adhesion therebetween. During the electrophotographic printing process, electric charges are first spread on the surface of the organic photoreceptor via a corona discharge. After exposure to a laser light, electric charges are generated in the exposed areas of the charge generating layer which are then transported through the charge transport layer to reach the surface of the photoreceptor at which they neutralize the electric charges formed by the initial corona discharge, to thus form a latent image. After the application of a toner on the photoreceptor, a positive toner image is formed which is then transferred to a paper or transparency film. The toner image is fixed onto the medium by heat-pressing. This completes the electrophotographic printing process.

During the high-voltage corona discharge, some of the oxygen and nitrogen molecules in the air can be converted into $O_3$ and $No_x$. The latter can further be combined with moisture to form $HNO_3$ Both $O_3$ and $HNO_3$ molecules can cause damages to the charge transport layer resulting in deterioration of the print quality. Furthermore, some of the charge transport layers contain binders which are sensitive to humidity content in the environment, causing the print quality to depend on ambient humidity. These two problems cause the less than desired properties of organic photoreceptors. Recently, as a result of high speed printing, the abrasion-resistance of organic photoreceptors, or more specifically the lack thereof, has also become an important concern.

In U.S. Pat. No. 5,401,615, the content thereof is incorporated herein by reference, it is disclosed an electrophotographic imaging member with improved oxidative stability which is prepared by (1) forming on a charge generating layer a first coating including charge transporting molecules, such as N,N'-diphenyl-N-N'-bis(3-methylphenyl)-(1,1'-biphenyl)-4,4'-diamine, dispersed in a solution of a first polymer binder dissolved in a first solvent, (2) drying the coating to remove the solvent to form a substantially dry charge transport layer, (3) forming on the charge transport layer a second coating including charge transporting molecules and a chemical stabilizer additive. The chemical stabilizer additive is selected from the group consisting of nitrone, isobenzofuran, hydroxyaromatic compound.

In U.S. Pat. No. 5,391,449, the content thereof is incorporated herein by reference, it is disclosed an electrophotographic photosensitive member with improved abrasion resistence which formed by disposing a photosensitive layer and a protective layer in this order on an electroconductive support. The protective layer is formed from a resin obtained by polymerization of a curable acrylic monomer having at least three acrylic groups, i.e., acryloyl and/or methacryloyl groups. The protective layer disclosed in the '449 patent must also contain about 30 wt % of electroconductive particles, including electroconductive $SnO_2$ particles having a particle size less than about 500 Å. One of the shortcomings of the '449 invention is that the $SnO_2$ particles may aggregate with time, thus, adversely affecting the effectiveness of the protective layer.

The aggregation problems experienced by the electroconductive particles of the '449 invention may be overcome by treating the electroconductive particles with siloxane compound. During the treatment, the siloxane compound is adhered to the surface of the electroconductive particles to reduce the hydroscopicity thereof. In U.S. Pat. No. 5,385,797, the content thereof is incorporated herein by reference, it is disclosed such process of treating the electroconductive particles with siloxane compound. While the photographic photosensitive members prepared in the '797 patent exhibited good photoelectric and abrasion-resistant characteristics, the process so involved is relatively complicated and expensive, and may not be readily applicable for use in cost-conscious mass productions.

Because of the ever-increasing consumption rate and the huge potential market of photoreceptors, any improvement is a welcoming news and it is important to develop better protective materials for this application. In addition to the above patents, other protective materials have also been proposed. In U.S. Pat. No. 5,485,250, the content thereof is incorporated herein by reference, it is disclosed, among other things, an electrophotographic photosensitive member having a conductive support, a photosensitive layer, and a surface layer. The surface layer contains (a) a binder resin (2) fluorine atom- or silicon atom-containing compound particles incompatible with the binder resin, and (3) fluorine atom- or silicon atom-containing compound particles compatible with the binder resin.

U.S. Pat. No. 5,393,628, the content thereof is incorporated herein by reference, discloses an electrophotographic photosensitive member having a conductive support, a photosensitive layer, and a protective layer. To improve its resistance against $O_3$ or $NO_x$, at least one of the photosensitive layer or the protective layer contains a pyrazine derivative. The protective layer of the '628 invention, however, does not provide improvement regarding abrasion resistance or other mechanical stability.

Current proliferation of laser printers opens a huge demand of electrophotographic photoreceptors, and the trend continues. Thus, it is always important to develop improved materials that can provide either improved performance or better cost-effectiveness, or preferably both.

SUMMARY OF THE INVENTION

The primary object of the present invention is to develop electrophotographic photoreceptors with improved chemical and mechanical strengths and desired photoelectric characteristics. More specifically, the primary object of the present invention is to develop a protective layer, which, when provided on the surface of an electrophotographic photoreceptor, imparts improved anti-oxidative-resistance, abrasion-resistance, and weather-resistance to the electrophotographic photoreceptor, so as to allow the electrophotographic photoreceptor to retain good photoelectric properties after repeated use.

After many years of dedicated research efforts, the co-inventors have unexpectedly found that, by subjecting phenolic resin to a special heat treatment process, an excellent protective layer can be obtained which comprises a cross-linked phenolic resin having two types of linkages present at a specific weight ratio, as indicated by a specific oxygen content of the cross-linked phenolic resin.

The first type of linkage is a methylene ether linkage represented by the following formula:

Methylene ether linkage:

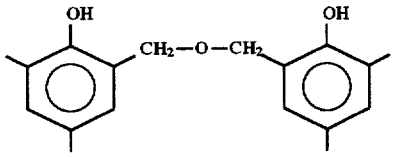

The second type of linkage is a methylene linkage represented by the following formula:

Methylene linkage:

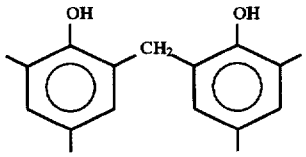

Excellent photoelectric properties are observed when the heat-treated cross-linked phenolic resin has an oxygen content, via elemental analysis, less than or equal to 23.5 wt %, or preferably between about 21.0 wt % and about 23.5 wt %.

Since the oxygen content in the methylene ether linkage is 23.7 wt % (32 divided by 135), and the oxygen content in the methylene linkage is 15.2 wt % (16 divided by 105), the above requirement can be translated into at most 97.5 mol %, or preferably between about 68.2 mol % and 97.5 mol %, of the total linkages being the methylene ether linkage. In other words, the heat-treated cross-linked phenolic resin in the protective layer of the present invention has both methylene ether linkages and methylene linkages at a molar ratio of about 39:1, or preferably between 2:1 and 39:1.

In a preferred embodiment of the present invention, the protective layer is formed by first applying a layer of phenolic resin on the surface of an electrophotographic receptor. Then the electrophotographic receptor along with the phenolic resin layer is heated at 70° C. for 30 minutes, 100° C. for 30 minutes, 130° C. for 30 minutes, 90° C. for 15 minutes, then 70° C. for 15 minutes. After this heat treatment cycle, an elemental analysis reveals that the heat-treated and cross-linked phenolic resin contains the following chemical composition (weight percent): C=72.4±0.5%; H=6.1±0.5%; and O (balance)=21.5±0.5%. If the phenolic resin is not properly treated, the cross-linking structure may not fall into the right range and the advantageous protectiveness may not be obtained even though the same phenolic resin is used.

A small amount of thermoplastic resin, such as polyvinyl butyral resin or polyamide, can be added to the phenolic resin to further enhance the surface smoothness of the final protective layer. The thermoplastic resin should be added to the extent that it does not affect the electrophotographic and other mechanical characteristics of the protective layer.

In summary, by properly controlling the cross-linking structure of phenolic resin, a novel protective layer can be obtained for electrophotographic receptors. The protective layer disclosed in the present invention provides the following advantages:

(a) it protects the photoreceptor against oxidation by $O_3$ and $HNO_3$, which may be generated during the high voltage corona discharge;

(b) it exhibits the desired photoelectric properties and does not cause any impedance against the movement of electrical charges to the surface of the photoreceptor, thus allowing the overall photoelectric properties of the photoreceptor to be maintained;

(c) it also exhibits desirable mechanical strength;

(d) its mechanical and photoelectric properties are constant over wide ranges of temperature and humidity;

(e) because the protective layer of the present invention does not contain particles, it is provided in the form of a film with a very smooth surface, thus it will not affect the transmittance of laser light through the electrophotographic receptor; and (f) before cross-linking, the protective layer of the present invention can be dissolved in solvents that will not dissolve the binder provided in the charge transfer layer, nor will the any of the solvents extract the charge transport material from the charge transfer layer.

The protective layer disclosed in the present invention can be applied on the surface of a variety of multi-layer-structured photoreceptors.

BRIEF DESCRIPTION OF THE DRAWING

The present invention will be described in detail with reference to the drawing showing the preferred embodiment of the present invention, wherein:

FIGS. 1(*a*)–1(*f*) are schematic cross-sectional views of the various types of the multi-structured photoreceptors each having a protective layer of the present invention.

DETAILED DESCRIPTION OF THE PREFERRED EMBODIMENT

The present invention discloses an electrophotographic photoreceptor with improved chemical mechanical strengths while maintaining desired photoelectric characteristics. In the present invention, a protective layer, which contains a novel heat-treated phenolic resin having a predetermined mix of cross-linkages among the phenolic groups, is provided on the surface of an electrophotographic photoreceptor to impart improved anti-oxidative-resistance, abrasion-resistance, and weather-resistance to the electrophotographic photorecepter. The electrophotographic photoreceptor of the present invention can provide good photoelectric properties under high temperature and high humidity environment, and after repeated use.

The cross-linked phenolic resin disclosed in the present invention for use as a protective layer for electrophotographic photoreceptors contains two types of phenolic linkages present at a specific weight ratio, which can be specified by a specific oxygen content of the cross-linked phenolic resin. In a preferred embodiment of the present invention, the specifically cross-linked phenolic resin was prepared by a treatment which included a first step of raising treatment temperature from about 70°–90° C. to about 130° C. in a cascading manner, followed by a second step of lowering temperature from about 130° C. to about 70°–90° C., also in a cascading manner.

The first type of linkage is a methylene ether linkage represented by the following formula:

Methylene ether linkage:

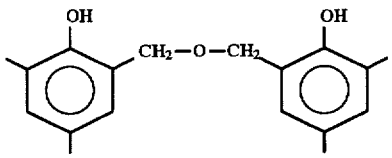

The second type of linkage is a methylene linkage represented by the following formula:

Methylene linkage:

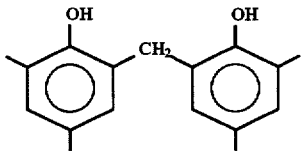

Excellent photoelectric properties are observed when the heat-treated cross-linked phenolic resin has an oxygen content, via elemental analysis no greater than 23.5 wt %, or preferably between about 21 wt % and about 23.5 wt %.

Since the oxygen content in the methylene ether linkage is 23.7 wt %, and the oxygen content in the methylene linkage is 15.2 wt %, the above requirement can be translated into below 23.5 mol %, or between about 68 mol % and about 97.5 mol %, of the total linkages among the phenol groups being methylene ether linkages. Alternatively, the heat-treated cross-linked phenolic resin in the protective layer of the present invention has both methylene ether linkages and methylene linkages at a molar ratio of about 39:1, or between 2:1 and 39:1. In other words, the heat treatment process (for cross-linking phenolic resins) should be designed such that the cross-linked phenolic resin contains at least a small amount of the methylene linkage (at least 2.5 mol %); but the amount of methylene linkages should not be greater than one-third of the total linkages.

FIGS. 1(*a*)–(*f*) show the various arrangements of the plurality of layers in a multi-layered organic photoreceptor; all of them contain a protective layer of the present invention at the outmost surface thereof. FIG. 1(*a*), which is the most common arrangement, shows a protective layer (PL), a charge transport layer (CTL), and a charge generation layer (CGL), provided in this order on top of a conductive aluminum substrate (AL). During a printing process, electric charges are spread on the surface of the organic photoreceptor via a corona discharge. After exposure to a laser light, electric charges are generated in the indirectly exposed areas of the charge generating layer CGL which are then transported through the charge transport layer CTL to reach the surface of the photoreceptor at which they neutralize the electric charges initially caused by the corona discharge to form a latent image. After the application of a toner, a positive toner image is formed which is than transferred to a paper or transparency. Finally, the toner image is fixed onto the medium by heat pressing to complete the printing process. A binder layer BL can be provided between the charge generating layer CGL and the substrate AL, as shown in FIG. 1(*c*), to provide insulation and improve adhesion therebetween. The positions of the charge generating layer CGL and the charge transport layer CTL can be reversed, as shown in FIGS. 1(*b*) and 1(*d*). Alternatively, the charge generating layer CGL and the charge transport layer CTL can be combined into a single layer, as shown in FIGS. 1(*e*) and 1(*d*).

In another preferred embodiment of the present invention, a small amount of thermoplastic resin, such as polyvinyl butyral resin or polyamide, can be added to the phenolic resin to further enhance the surface smoothness of the final protective. The thermoplastic resin should be added to the extent that it does not affect the electrophotographic and other mechanical characteristics of the protective layer.

As discussed before, the protective layer of the present invention, which contains a phenolic resin with a novel cross-linking structure as defined by a predetermined oxygen content, provides the following advantages:

(a) it effectively protects the photoreceptor against oxidation by $O_3$ and $HNO_3$ so as to allow the good print quality to be retained;

(b) the specifically cross-linked phenolic resin exhibits desired photoelectric properties which does not adversely affect the movement of electrical charges to the surface of the photoreceptor, thus allowing the overall photoelectric properties of the photoreceptor to be maintained at the desired level;

(c) it exhibits desirable mechanical strength;

(d) the mechanical and photoelectric properties of the resultant photoreceptor are constant over wide ranges of temperature and humidity;

(e) because the protective layer of the present invention does not contain particles, it is provided in the form of a film with a very smooth surface; thus it will not affect the transmittance of laser light through the electrophotographic receptor; and (f) before cross-linking, the protective layer of the present invention can be dissolved into solvents that will not dissolve the binder provided in the charge transfer layer, nor will the any of these solvents extract the charge transport material from the charge transfer layer.

The present invention will now be described more specifically with reference to the following examples. It is to be noted that the following descriptions of examples, including the preferred embodiment of this invention, are presented herein for purposes of illustration and description, and are not intended to be exhaustive or to limit the invention to the precise form disclosed.

EXAMPLE 1

An anode-treated aluminum substrate was coated with, in the order away therefrom, a charge generating layer having a thickness of 0.2 μm, a charge transport layer having a thickness of 20 μm and a protective layer having a thickness of 3.0 μm, to form an organic photoreceptor. The charge generating layer contained 2.0% (by weight) of oxytitanium phthalocyanine, 2.0% PVB, 48% methyl ethyl ketone and 48% cyclohexanone. The charge transport layer contained 12.5% hydrazone, 12.5% polycarbonate resin, and 75% toluene. The protective layer contained 50% phenolic resin (obtained from Sumitomo Co. of Japan) and 50% ethanol. After the protective layer was coated on the outermost surface of the photoreceptor, it was then subjected to a heat treatment at 70° C. for 30 minutes, 100° C. for 30 minutes, 130° C. for 30 minutes, 90° C. for 15 minutes, final at 70° C. for 15 minutes. An elemental analysis revealed that the heat-treated and cross-linked phenolic resin contained the following chemical composition (weight percent): C=72.4±0.5%; H=6.1±0.5%; and O (balance)=21.5±0.5%.

The photoelectric properties of the organic photoreceptor were tested under a photo-induced charge decay (PICD) method using a QEA-PDT2000 OPC machine. This method involved a corona discharge to apply a negative voltage ($V_0$) of −690 volts onto the surface of the photoreceptor. The charge was held for 2 seconds without light exposure to allow the surface of the photoreceptor to reach a dark development potential ($V_{ddp}$), typically the same as $V_0$. A dark decay potential ($V_{dd}$) is defined as the difference between $V_0$ and $V_{ddp}$ after these two seconds. The photoreceptor was then exposed to a halogen lamp having a wavelength of 780 nm and an exposure density of 1.0 μJ/cm$^2$. The photoelectric properties of the photoreceptor were evaluated based on their dark decay potential, residual potential ($V_r$) and half-decay energy density ($E_{1/2}$). The residual potential ($V_r$) is defined as the surface potential after the conclusion of the illumination, and the half-decay energy density ($E_{1/2}$) is defined as the light density required to reduce the dark development potential to half of its value. A higher value of $E_{1/2}$, indicates a better sensitivity of the photoreceptor.

The photoreceptor was also subject to a life test, by which the photoreceptor was first installed in a laser printer then removed after printing 10,000 copies to test its potential. The test environment was at a relatively high temperature (T=32° C.) and high relative humidity (RH=80%). Test results were evaluated using the following equation:

$$\Delta(ID) = \frac{(ID)_{HTHH} - (ID)_{RTRH}}{(ID)_{RTRH}} \times 100\%$$

In the above equation, ID (image density) was the blackness measured using Macbeth PD-921 blackness tester, $(ID)_{HTHH}$ and $(ID)_{RTRH}$ are the blackness measured at high-temperature-high-humidity environment (32° C., RH=80%) and normal ("room") environment (25° C., RH=50%), respectively. Nine points were measured and the average values were reported for comparison. A higher value of Δ(ID) indicates a poor weatherability, discourage toner particles to be attached thereto.

Table 1 shows results of PIDC tests on the photoreceptor of Example 1. The dark decay potential $V_{dd}$ was measured to be 20 volts, the residual potential $V_r$ was 76 volts, and the half-decay energy density $E_{1/2}$ was 0.20 μJ/cm$^2$. Environmental tests indicated that it had excellent printing quality (Δ(ID)=0). The photoreceptor was also subject to a life test as described above. After printing 10,000 copies, the blackness remained unchanged, as shown in Table 2. Also as indicated in Table 2, after printing 10,000 copies, the photoreceptor showed a dark development potential $V_{ddp}$ of 690 volts, a dark decay potential $V_{dd}$ of 22 volts (an increase of only 2 volts), a residual potential $V_r$ of 77 volts (an increase of only one volt), and half-decay energy density $E_{1/2}$ of 0.20 μJ/cm$^2$ (unchanged). The high print quality after long time use indicates excellent abrasion resistance and stability of the photoreceptor of the present invention.

EXAMPLE 2

The photoreceptor in Example 2 was prepared according to essentially the same procedure as in Example 1, except that the phenolic resin was obtained from Nan Pao, Taiwan (Nan Pao Resin 203), and that the cross-linking temperatures were at 80° C. for 30 minutes, 100° C. for 30 minutes, 130° C. for 30 minutes, 90° C. for 30 minutes, and finally 80° C. for 30 minutes. The protective layer was analyzed to have an elemental composition of: C=71.4±0.5%, H=5.9±0.5%, and O=22.7±0.5%. Results of PIDC tests were also shown in Table 1. The dark decay potential $V_{dd}$ was measured to be 10 volts, the residual potential $V_r$ was 50 volts, and the half-decay energy density $E_{1/2}$ was 0.23 μJ/cm$^2$. Environmental tests indicated that it had excellent printing quality (Δ(ID)=0).

EXAMPLE 3

The photoreceptor in Example 3 was prepared according to essentially the same procedure as in Example 1, except that the phenolic resin was obtained from Chia-Hsin, Taiwan (Chia Hsin Resin, TR6660), and that the cross-linking temperatures were at 90° C. for 30 minutes, 100° C. for 30 minutes, 130° C. for 30 minutes, ad finally at 90° C. for 30 minutes. The protective layer was analyzed to have an elemental composition of: C=71.3±0.5%, H=5.7±0.5%, and O=23.0±0.5%. Results of PIDC tests were also shown in Table 1. The dark decay potential $V_{dd}$ was measured to be 22 volts, the residual potential $V_r$ was 70 volts, and the half-decay energy density $E_{1/2}$ was 0.23 μJ/cm$^2$. Environmental tests indicated that it had excellent printing quality (Δ(ID)=0).

EXAMPLE 4

The photoreceptor in Example 4 was prepared according to essentially the same procedure as in Example 2, except that an insulation layer (copolyamide, tradename CM8000, 1.0 μm) was formed between the charge generating layer and the substrate. Results of PIDC tests were also shown in Table 1. The dark decay potential $V_{dd}$ was measured to be 22 volts, the residual potential $V_r$ was 63 volts, and the half-decay energy density $E_{1/2}$ was 0.22 μJ/cm$^2$. Environmental tests indicated that it had excellent printing quality (Δ(ID)=0).

EXAMPLE 5

The photoreceptor in Example 5 was prepared according to essentially the same procedure as in Example 4, except that the protective layer contained 48.5% (by weight) of the phenolic resin, 1.5% of polyvinyl butyral resin, 25% of methanol and 25% ethanol. Results of PIDC tests were also shown in Table 1. The dark decay potential $V_{dd}$ was measured to be 21 volts, the residual potential $V_r$ was 71 volts, and the half-decay energy density $E_{1/2}$ was 0.23 μJ/cm$^2$. Environmental tests indicated that it had excellent printing quality (Δ(ID)=0).

EXAMPLE 6

The photoreceptor in Example 6 was prepared according to essentially the same procedure as in Example 4, except that the protective layer contained 48.0% (by weight) of the phenolic resin, 2.0% of copolyamide (Tradename CM8000), 25% of ethanol and 25% n-butanol. Results of PIDC tests were also shown in Table 1. The dark decay potential $V_{dd}$ was measured to be 21 volts, the residual potential $V_r$ was 75 volts, and the half-decay energy density $E_{1/2}$ was 0.23 μJ/cm$^2$. Environmental tests indicated that it had excellent printing quality (Δ(ID)=0).

Comparative Example 1

The photoreceptor in Comparative Example 1 was prepared according to essentially the same procedure as in Example 4, except that no protective layer was provided. Results of PIDC tests were also summarized in Table 1. The dark decay potential $V_{dd}$ was measured to be 12 volts, the residual potential $V_r$ was 50 volts, and the half-decay energy density $E_{1/2}$ was 0.23 μJ/cm$^2$. Environmental tests indicated that it had poor printing quality (Δ(ID)=44%), and poor toner attachment.

Comparative Example 2

The photoreceptor in Comparative Example 2 was prepared according to essentially the same procedure as in Example 2, except that the protective layer was heated at 140° C. for 120 minutes. Results of PIDC tests were also summarized in Table 1. The dark decay potential $V_{dd}$ was measured to be 42 volts, the residual potential $V_r$ was 107 volts, and the half-decay energy density $E_{1/2}$ was 0.27 μJ/cm$^2$. Environmental tests indicated that it had good printing quality (Δ(ID)=44%), and good toner absorption. However, improper heat treatment resulted in very poor photoelectric properties.

Comparative Example 3

The photoreceptor in Comparative Example 3 was prepared according to essentially the same procedure as in Example 2, except that the protective layer was heated at 70° C. for 30 minutes, 100° C. for 30 minutes, 120° C. for 30 minutes, 90° C. for 15 minutes, finally 70° C. for 15 minutes. Results of PIDC tests were also summarized in Table 1. The dark decay potential $V_{dd}$ was measured to be 16 volts, the residual potential $V_r$ was 63 volts, and the half-decay energy density $E_{1/2}$ was 0.23 μJ/cm$^2$. While the photoreceptor of Comparative Example 3 showed adequate photoelectric properties, environmental tests indicated that it had poor printing quality (blurred images) at high temperature and high humidity environment, as a result of poor mechanical strength due to improper heat treatment. The protective layer in Comparative Example 3 was analyzed to have an elemental composition of: C=70.1±0.5%, H=6.4±0.5%, and O=23.5±0.5%.

Comparative Example 4

The photoreceptor in Comparative Example 4 was prepared according to essentially the same procedure as in Example 1, except that no protective layer was provided. Results of PIDC tests were also summarized in Table 1. The dark decay potential $V_{dd}$ was measured to be 18 volts, the residual potential $V_r$ was 47 volts, and the half-decay energy density $E_{1/2}$ was 0.20 μJ/cm$^2$. Environmental tests indicated that it had poor printing quality (Δ(ID)=42%). After 10,000 print copies (during a life test), the dark decay potential $V_{dd}$ was measured to be 43 volts (an increase of 25 volts), the residual potential $V_r$ was 62 volts (an increase of 15 volts), and the half-decay energy density $E_{1/2}$ was 0.25 μJ/cm$^2$ (an increase of 0.05 μJ/cm$^2$). These results indicate undesired large deterioration in its print quality after repeated use.

The foregoing description of the preferred embodiments of this invention has been presented for purposes of illustration and description. Obvious modifications or variations are possible in light of the above teaching. The embodiments were chosen and described to provide the best illustration of the principles of this invention and its practical application to thereby enable those skilled in the art to utilize the invention in various embodiments and with various modifications as are suited to the particular use contemplated. All such modifications and variations are within the scope of the present invention as determined by the appended claims when interpreted in accordance with the breadth to which they are fairly, legally, and equitably entitled.

TABLE 1

| | dark decay potential ($V_{dd}$, volts) | residual potential ($V_r$, volts) | half-decay energy density ($E_{1/2}$, μJ/cm$^2$) | Environment Test (ΔID, %) |
|---|---|---|---|---|
| Example 1 | 20 | 76 | 0.20 | 0 |
| Example 2 | 10 | 50 | 0.23 | 0 |
| Example 3 | 22 | 70 | 0.23 | 0 |
| Example 4 | 22 | 63 | 0.22 | 0 |
| Example 5 | 21 | 71 | 0.23 | 0 |
| Example 6 | 21 | 75 | 0.23 | 0 |
| Comp. Ex. 1 | 12 | 50 | 0.23 | 44 |
| Comp. Ex. 2 | 42 | 107 | 0.27 | 0 |
| Comp. Ex. 3 | 16 | 63 | 0.23 | 0 |
| Comp. Ex. 4 | 18 | 47 | 0.20 | 42 |

TABLE 2

| | Before or After 10,000 Prints | dark development potential ($V_{ddp}$, volts) | dark decay potential ($V_{dd}$, volts) | residual potential ($V_r$, volts) | half-decay energy density ($E_{1/2}$, μJ/cm$^2$) | Image Density (ID) |
|---|---|---|---|---|---|---|
| Example 1 | Before | 695 | 20 | 76 | 0.20 | 1.39 |
| | After | 690 | 22 | 77 | 0.20 | 1.39 |
| Comp. Ex. 4 | Before | 686 | 18 | 47 | 0.20 | 1.40 |
| | After | 688 | 43 | 62 | 0.25 | 1.33 |

What is claimed is:

1. An organic electrophotographic photoreceptor containing a protective layer, wherein said protective layer comprises a cross-linked phenolic resin having methylene ether and methylene linkages that are provided such that said cross-linked phenolic resin has an oxygen element content no greater than 23.5 wt %.

2. The organic electrophotographic photoreceptor according to claim 1 wherein methylene ether and methylene linkages that are provided such that said cross-linked phenolic resin has an oxygen element content between about 21 wt % and 23.5 wt %.

3. The organic electrophotographic photoreceptor according to claim 1 wherein said cross-linked phenolic resin is obtained through a heat treatment process which comprises the following steps:

(a) raising treatment temperature from 80°±10° C. to about 130° C., in a cascading manner involving at least one intermediate treatment temperature; and (b) lowering treatment temperature from about 130° C. to 80°±10° C.

4. The organic electrophotographic photoreceptor according to claim 1 wherein said cross-linked phenolic resin is obtained by a cross-linking process which comprises the following steps:

(a) dissolving a phenolic resin in an alcohol solvent;

(b) coating said phenolic resin dissolved in said alcohol solvent onto an outermost surface of said electrophotographic photoreceptor; and (c) subjecting said phenolic resin to a heat treatment process.

5. The organic electrophotographic photoreceptor according to claim 4 wherein said alcohol solvent is selected from the group consisting of methanol, ethanol, propanol, butanol, and mixtures thereof.

6. The organic electrophotographic photoreceptor according to claim 4 wherein said phenolic resin and said alcohol solvent are provided in a ratio between 15:75 and 50:50, by weight.

7. The organic electrophotographic photoreceptor according to claim 4 wherein said protective layer further comprises an alcohol-soluble thermoplastic resin.

8. The organic electrophotographic photoreceptor according to claim 7 wherein said alcohol-soluble thermoplastic resin is selected from the group consisting of polyvinyl butyral and polyamide.

9. An organic electrophotographic photoreceptor containing a protective layer, wherein said protective layer comprises a cross-linked phenolic resin having methylene ether and methylene linkages that are provided such that no greater than 97.5 mol % of the cross-linkages are methylene ether linkages.

10. The organic electrophotographic photoreceptor according to claim 9 wherein methylene ether and methylene linkages that are provided such that no greater than ⅓, on a molar basis, of the cross-linkages are methylene linkages.

11. The organic electrophotographic photoreceptor according to claim 9 wherein said cross-linked phenolic resin is obtained through a heat treatment process which comprises the following steps:

(a) raising treatment temperature from 80°±10° C. to about 130° C., in a cascading manner involving at least one intermediate treatment temperature; and (b) lowering treatment temperature from about 130° C. to 80°±10° C.

12. The organic electrophotographic photoreceptor according to claim 9 wherein said cross-linked phenolic resin is obtained by a cross-linking process which comprises the following steps:

(a) dissolving a phenolic resin in an alcohol solvent;

(b) coating said phenolic resin dissolved in said alcohol solvent onto an outermost surface of said electrophotographic photoreceptor; and (c) subjecting said phenolic resin to a heat treatment process.

13. The organic electrophotographic photoreceptor according to claim 12 wherein said alcohol solvent is selected from the group consisting of methanol, ethanol, propanol, butanol, and mixtures thereof.

14. The organic electrophotographic photoreceptor according to claim 12 wherein said phenolic resin and said alcohol solvent are provided in a ratio between 15:75 and 50:50, by weight.

15. The organic electrophotographic photoreceptor according to claim 12 wherein said protective layer further comprises an alcohol-soluble thermoplastic resin.

16. The organic electrophotographic photoreceptor according to claim 15 wherein said alcohol-soluble thermoplastic resin is selected from the group consisting of polyvinyl butyral and polyamide.

* * * * *